US007425901B2

(12) United States Patent
Groover

(10) Patent No.: US 7,425,901 B2
(45) Date of Patent: Sep. 16, 2008

(54) BABY MONITORING SYSTEM WITH RECORDING CAPABILITY

(76) Inventor: Jennifer Ann Groover, 1 Windbrook Dr., Springfield, PA (US) 19064

( * ) Notice: Subject to any disclaimer, the term of this patent is extended or adjusted under 35 U.S.C. 154(b) by 270 days.

(21) Appl. No.: 11/360,310

(22) Filed: Feb. 23, 2006

(65) Prior Publication Data

US 2006/0197671 A1 Sep. 7, 2006

Related U.S. Application Data

(60) Provisional application No. 60/655,992, filed on Feb. 24, 2005.

(51) Int. Cl.
*G08B 23/00* (2006.01)

(52) U.S. Cl. ..... 340/573.1; 340/539.15

(58) Field of Classification Search ..... 340/573.1, 340/539.15

See application file for complete search history.

(56) References Cited

U.S. PATENT DOCUMENTS 6,043,747 A 3/2000 Altenhofen ..... 340/573.1
6,593,851 B1 * 7/2003 Bornstein ..... 340/539.15
6,766,145 B2 7/2004 Fitzgerald et al. ..... 455/67.11
6,975,832 B2 * 12/2005 Adams et al. ..... 434/317
2004/0199391 A1 * 10/2004 Yoon et al. ..... 704/275
2004/0264938 A1 * 12/2004 Felder ..... 386/96

* cited by examiner

*Primary Examiner*—Thomas J Mullen, Jr.
(74) *Attorney, Agent, or Firm*—Gregory S. Bernabec; Saul Ewing LLP

(57) ABSTRACT

A baby monitoring system including a baby unit for receiving audio signals, and a parent unit for reproducing an audio signal received at the baby unit. At least one of the baby and parent units includes audio signal recording capability, e.g. using a digital voice recorder. Preferably, at least one of the units includes a port capable of outputting data representing a stored audio signal, such that the data can be stored in a memory of a PC or other device. Thus, a baby's sounds/words may be monitored and recorded/stored in the memory of the baby monitoring system, downloaded to a separate device with long term storage capability, and the memory of the baby monitoring system may be reused to record new sounds, causing deletion of previously recorded sounds from the baby monitoring system's memory while permitting long term retention of a record of such sounds in the separate device.

21 Claims, 3 Drawing Sheets

BABY MONITORING SYSTEM WITH RECORDING CAPABILITY

CROSS-REFERENCE TO RELATED APPLICATION

This application claims the benefit of U.S. Provisional Patent Application No. 60/655,992, filed Feb. 24, 2005, the entire disclosure of which is hereby incorporated herein by reference.

FIELD OF THE INVENTION

The present invention relates generally to baby monitors and more particularly to a baby monitoring system of a type generally used by parents to monitor from a remote location a baby in a baby's room.

BACKGROUND OF THE INVENTION

The present invention relates generally to baby monitors and more particularly to a baby monitoring system that includes a parent unit and a baby unit that have a one-way or two-way radio frequency communications link established therebetween. Baby monitor systems of this type, such as the Fisher-Price® Sweet Dreams Monitor™ manufactured and/or sold by Mattel, Inc. of El Segundo, Calif., are well known in the art.

Some baby monitors include certain limited recording functionality. For example, U.S. Pat. No. 6,043,747 to Altenhofen discloses a baby monitor system that includes a message storage mechanism. More specifically, the parent unit, which is carried by the parent, includes a microphone that allows a care giver to record and store in a digital message memory at the parent unit a soothing message for playback to the baby via the baby unit, which remains in the baby's room. In response to activation of a play switch on the parent unit, the message is reproduced by a speaker on the baby unit. The entire disclosure of U.S. Pat. No. 6,043,747 is hereby incorporated herein by reference.

U.S. Pat. No. 6,766,145 discloses a child monitor system that is similar to conventional nursery room baby monitors in that includes a local unit (carried by the parent) and a remote unit (located in the child's room) that are capable of wirelessly communicating with each other. Each unit has the capability of receiving and outputting acoustic audio signals as well as the capability of transmitting and receiving the signals to and from the units. In one embodiment, the local unit includes a memory in which input signals from either unit may be stored prior to being output. For example, the memory may be implemented by a common digital recording integrated circuit such as a commercially available Winbond Electronics Corp. voice recorder with SRAM. This allows a user to save and later playback sounds made by infant near the remote unit. Accordingly, the system receives, at the remote (baby) unit, sounds made by an infant and transmits the sounds to the local (parent) unit. The system then stores the sounds in the memory of the local (parent) unit. In order to output these recorded sounds, the system retrieves the infant sounds from the memory and outputs the sounds at a speaker of the local unit. In operation, the end-user pushes a record button to record and the system records sounds over sounds previously recorded and stored in memory. The entire disclosure of U.S. Pat. No. 6,766,145 is hereby incorporated herein by reference.

SUMMARY

Conventional baby monitors seek to monitor a baby's well being, etc. The inventor hereof has determined that baby monitors are inadequate for recording and storing a baby's speech/sounds, and for creating a record of such speech/sounds that may be maintained in long term storage and subsequently accessed therefrom, e.g. for archival and/or nostalgic purposes. It has been determined that it would be desirable to combine such recording and storage functionality with conventional and/or existing baby monitoring functionality.

The present invention provides such a baby monitoring system. In particular, at least one of the baby unit and parent unit of the baby monitoring system includes a data output port capable of outputting data representing an audio signal stored in a memory of the units to and external long-term data storage device. Preferably the data output port is capable of outputting a data signal in digital or other form in a conventional format for plug—and—play interconnection with PC compatible electronic devices, such as a memory key/jump drive (collectively "memory key") with a USB connector.

In this manner, new sounds may be recorded in memory of the baby monitoring system, causing old sounds to be deleted from the memory, and yet a permanent/long-term record of the sounds may be retained in an external memory for later reference and/or reproduction, e.g. to retain a record of your child's first words that will allow for audio reproduction of those words using conventional PC hardware and/or software, or the like.

BRIEF DESCRIPTION OF THE DRAWINGS

The present invention will now be described by way of example with reference to the following drawings in which.

DETAILED DESCRIPTION

The present invention allows for recording and storing a baby's speech/sounds, and for creating a record of such speech/sounds that may be maintained in long term storage and subsequently accessed therefrom, e.g. for archival and/or nostalgic purposes.

Figure 1:
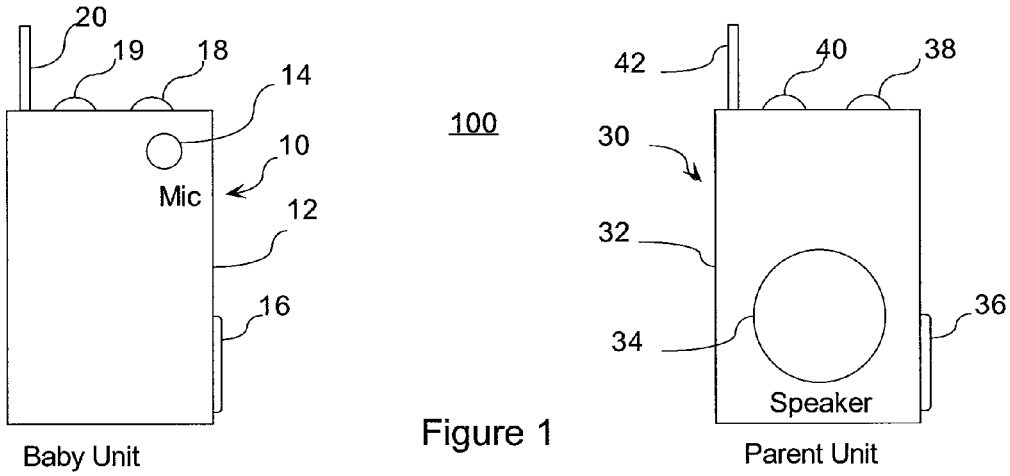
FIG. 1 is a diagram of an exemplary baby monitoring system including an exemplary baby unit and an exemplary parent unit in accordance with the present invention.

FIG. 1 shows an exemplary embodiment of a baby monitoring system 100 in accordance with the present invention. As shown in FIG. 1, the system 100 includes a baby unit 10 for placement in a baby's room to monitor the baby's speech/sounds, and a parent unit 30 for use by parents to remotely monitor the baby's speech/sounds by reproducing at its speaker, sounds picked up by a microphone of the baby unit 10.

In this embodiment, the parent unit 30 includes a molded plastic parent unit housing 32 which includes a speaker cover 34, and provides for receipt of a screw fastened battery compartment cover 36, an on/off switch 38; a volume control switch 40, and a parent unit antenna 42. With reference to FIGS. 2, 3, 4 and 5, the parent unit 30 also includes processing circuitry 48, an audio output transducer (speaker) 44, and a wireless receiver 46. Optionally, the parent unit's housing may include a conventional belt clip for attaching the parent unit to a user's belt.

Further, as shown in FIG. 1, in this exemplary embodiment, the baby unit 10 includes a molded plastic baby unit housing 12 which includes a microphone cover 14, and provides for receipt of a battery and/or an AC power adapter (not shown), an optional on/off switch 18, and a baby unit antenna 20. With reference to FIGS. 2, 3, 4 and 5, the baby unit 10 also includes processing circuitry 22, an audio input transducer (such as a condenser microphone) 24, and a wireless transmitter 26.

These components are well known in the art and function largely in a conventional manner, as described in greater detail in U.S. Pat. No. 6,766,145, the entire disclosure of which is incorporated herein by reference. By way of summary, the audio input transducer 24 of the baby unit 18 converts an incident acoustic input into a first input signal. Acoustic input can include speech, crying, breathing, and other sounds etc., from an infant or child (collectively, "baby"). The processing circuitry 22 of the baby unit converts the input signals into an output signal that is received by the wireless transmitter 26 for wireless transmission to the wireless receiver 46 of the parent unit 30.

Generally, the present invention operates as a baby monitor as follows. The audio input transducer 24 of the baby unit 10 receives a first acoustic input (baby speech/sounds) and converts it to a first input signal that is passed through to the transmitter 26 of the baby unit 10 via processing circuitry 22 (which may be incorporated into transmitter 26). The transmitter 26 of the baby unit 10 transmits this signal to the receiver 46 of the parent unit 30 by wireless transmission. The parent unit's receiver 46 passes the received signal on to its processing circuitry 48. The processing circuitry 48 of the parent unit converts the first output signal into a second output signal, which the output transducer (speaker) 44 converts into an audio (acoustic) output (reproduced speech/sounds).

Hardware for providing such functions is well known in the art and described in greater detail in U.S. Pat. No. 6,766,145. By way of summary, it is noted that power to the electronic components of the parent unit 30 is supplied by a main power supply which, in this exemplary embodiment, consists of a 9V battery housed in a battery compartment in housing 32. The baby unit 10 includes may include a similar power supply but preferably includes as an alternative an AC power adapter (not shown) for connection to a power supply. The audio input transducer 24 of baby unit 10 is implemented as an omnidirectional condenser microphone mounted on the housing 12. The transmitter and receiver circuitry used in the baby and parent units may be any suitable standard circuitry, as will be appreciated by those of ordinary skill in the art. By way of example, one suitable implementation is a 49 MHz system available from Excel Engineering, Ltd of Japan. Many other systems (including, for example, 900 MHz systems) are available from various suppliers. Similarly, any suitable system may be used for the conversion circuitry in the baby and parent units, by which the inputs from either baby unit microphone or parent unit receiver are converted to output signals for the baby unit transmitter or parent unit audio output transducer, respectively.

In accordance with the present invention, either the baby unit, or the parent unit, or both are provided with a memory, recording capability for storing in the memory recorded data for reproducing audio signals, and data output capability for transferring the recorded data from the memory to an external data storage device, such as external data memory. For example, a data output port is provided for connection of an external data memory device, such as a personal computer, which may include a writable CD or DVD drive, a computers hard disk drive, etc., or a USB or other port for connection of a stand alone hard drive, floppy disk drive, CD or DVD drive, tape drive, flash memory drive/key, or any other device capable of storing the data, and retaining the data apart from any memory of the baby unit or parent unit. In this manner, the memory of the baby unit or parent unit may be erased, and additional sounds may be recorded in the memory, while the parent may retain a record of the previously recorded sounds on the PC, etc.

The memory 50 may be implemented in any of a number of ways that will be apparent to one of ordinary skill in the art. By way of example, a commercially available digital recording integrated circuit such as a Winbond Electronics Corp. voice recorder with SRAM memory may be employed for this purpose.

Similarly, the Data Output Port 54 may be implemented in any of a number of ways that will be apparent to one of ordinary skill in the art, provided that the Data Output Port 54 is capable of transmitting data to a conventional electronic data storage device such as a PC, memory key, hard disk drive, I/O board of a PC, floppy disk drive, CD drive, DVD drive, etc. By way of example, a conventional USB port or cable may be employed for this purpose.

Figure 2:
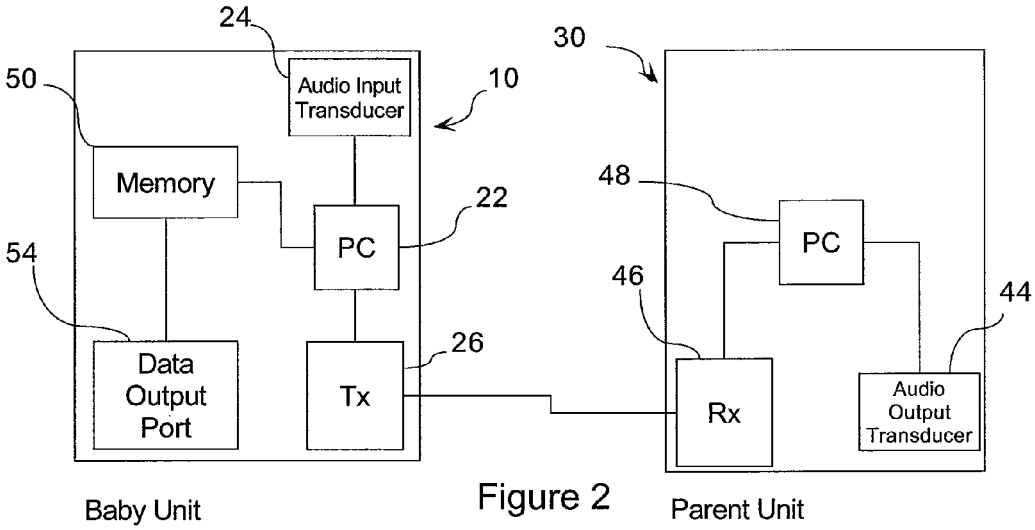
FIG. 2 is a schematic diagram showing the principal logical components of an exemplary embodiment of the baby and parent units of FIG. 1.

In the exemplary embodiment of FIG. 2, the baby unit 10 includes the memory 50 and the Data Output Port 54. The memory 50 is in communication with the audio input transducer 24 in order to store an audio signal received therefrom. In this exemplary embodiment the connection is made via processing circuitry 22 which processes the input audio signal and prepares it for storage in the memory and/or for output via the Data Output Port in a format compatible with commercially available computer software for reproducing audio signals, such as a *.mpg, *.wav, *.avi, *.wma, *.snd, *.au, *.mid, *.asf, or the like.

In this embodiment, in which the memory is in the baby unit, recording begins when the baby unit is switched on via the on/off switch 18. Alternatively, recording to the memory begins when an on/off recording button 19 on the baby unit is pressed. Recording to the memory stops when the memory is full, or when a predetermined amount of time has elapsed, or when the baby unit is switched off, or when the on/off recording switch 19 is pressed. In operation, the system records sounds over sounds previously recorded and stored in the memory. However, before recording over such sounds, such sounds may be copied from the memory via the data output port. By way of example, this may occur automatically upon connection of such a device, or the memory may be configured to act like a memory key, such that conventional PC software may be used to retrieve data from the memory and copy it to another storage device, such as the PC's hard disk drive. Accordingly, this configuration allows the user to record and later download for storage on an external storage device sounds made by a baby near the baby unit.

Figure 3:
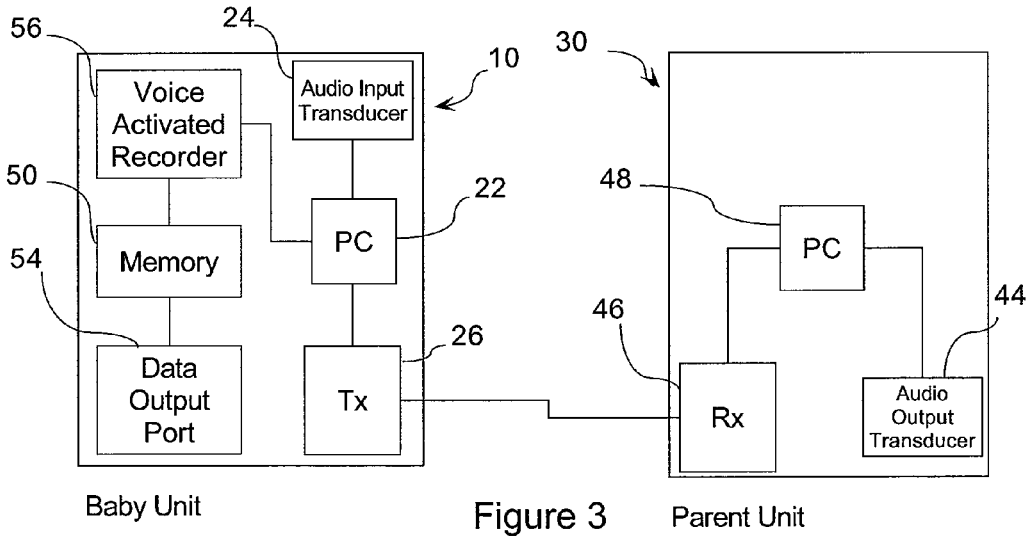
FIG. 3 is a schematic diagram showing the principal logical components of an alternative exemplary embodiment of baby and parent units of FIG. 1.

In the exemplary embodiment of FIG. 3, the baby unit 10 similarly includes the processing circuitry 22, memory 50, the Data Output Port 54. However, in this embodiment, the baby unit 10 also includes a Voice Activated Recorder (VAR) 56, which may be implemented by conventional circuitry or otherwise as will be appreciated by those skilled in the art. The VAR 56 senses when the baby is making sounds by monitoring the signal received from the audio input transducer 24, and initiating recording to the memory 50 only when it senses that such sounds are being made, and to stop/pause recording when it senses that such sounds are not being made. For example, the VAR 56 may include circuitry for determining when the audio signal includes more than mere background noise. Such VAR circuitry is commercially available and well known in the art. Accordingly, in this embodiment, the on/off recording button 19 is used to simply turn on or off the VAR 56. Other operation is similar to that described above.

Figure 4:
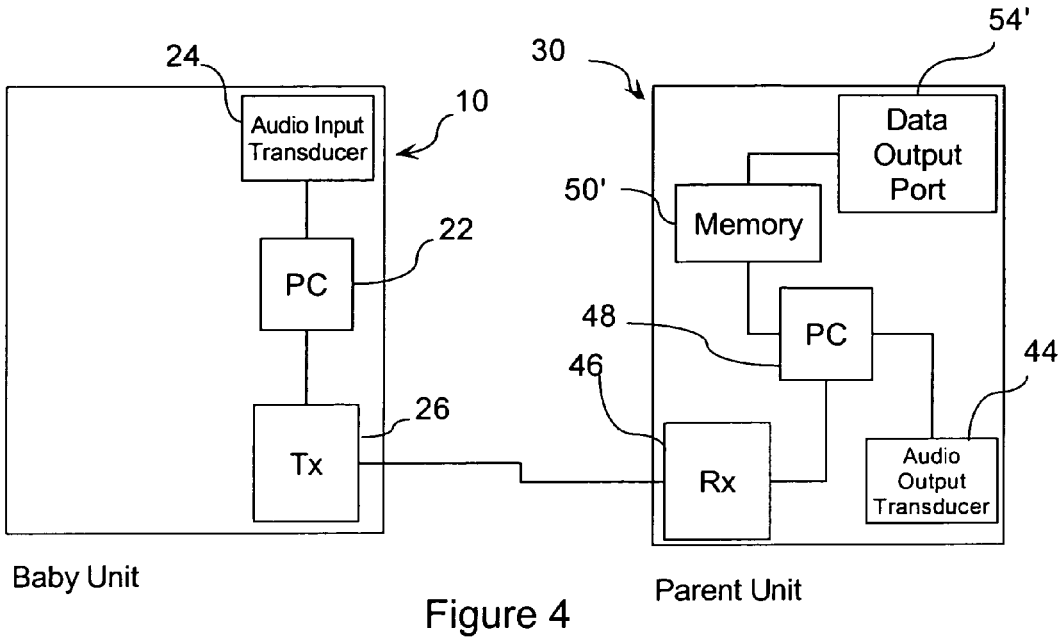
FIG. 4 is a schematic diagram showing the principal logical components of another alternative exemplary embodiment of baby and parent units of FIG. 1.
Figure 5:
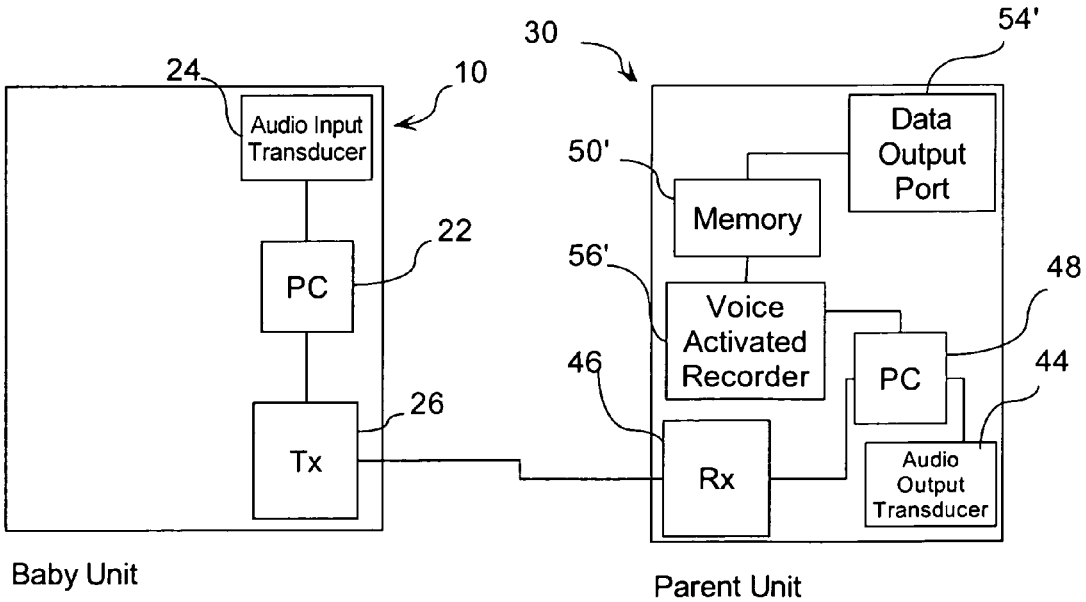
FIG. 5 is a schematic diagram showing the principal logical components of yet another alternative exemplary embodiment of baby and parent units of FIG. 1.

FIGS. 4 and 5 are somewhat similar to FIGS. 2 and 3 respectively, except that the memory 50', Data Output Port 54' and optional VAR 56' are provided in the parent unit 30. These components function in a manner corresponding to the manners described above. As discussed above, recording to the memory and/or turning on of the VAR 56' may be initiated by turning the parent unit 30 on via its on/off switch 38. Alternatively, and additional on/off recording button may be provided on the parent unit 30 similar to button 19 of the baby unit 10, for use as described above. It should be noted that in the embodiment of FIG. 5, the VAR 56' monitors signals received from the parent units receiver 46 and/or processing circuitry 48 to determine whether the baby is making sounds near the baby unit 10.

Figure 6:
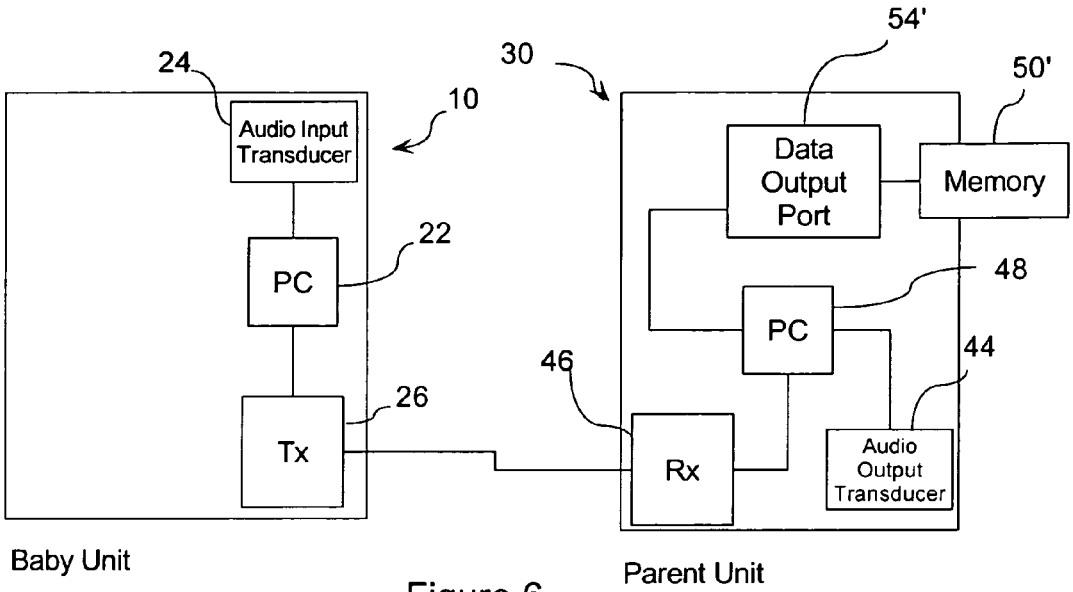
FIG. 6 is a schematic diagram showing the principal logical components of yet another alternative exemplary embodiment of baby and parent units of FIG. 1.

FIG. 6 shows an alternative embodiment of a parent unit or baby unit that includes a similar Data Output Port 54, but includes memory that is physically removable from the unit. For example, the memory may be provided in the form of a conventional memory key/flash drive/jump drive having a USB connector. In this manner, the memory may be physically removed from the unit and connected to a conventional PC or the like.

Figure 7:
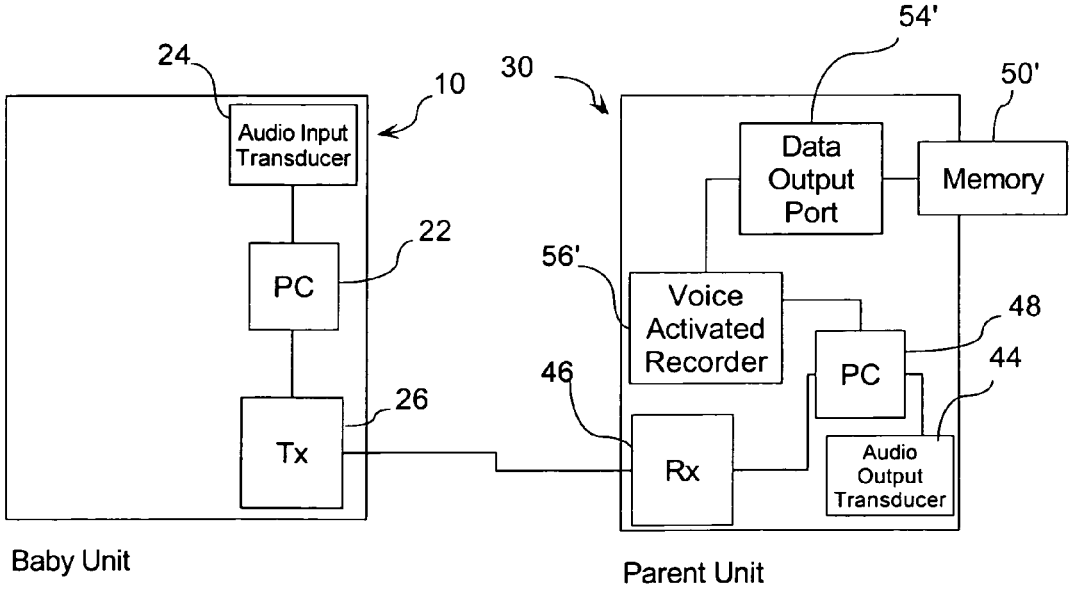
FIG. 7 is a schematic diagram showing the principal logical components of yet another alternative exemplary embodiment of baby and parent units of FIG. 1.

FIG. 7 shows an alternative embodiment similar to that of FIG. 6, but also including a VAR.

It should be understood that the embodiments shown are exemplary only and that other embodiments are within the scope of the present intention. By way of example, the memory, Data Output Port, and/or VAR need not be provided in the same unit. Instead some of these components may be provided in one of the baby unit and parent unit, and the other(s) of these components may be provided in the other of the baby unit and parent unit. For example, the VAR and memory may be provided in the baby unit, and the Data Output Port may be provided in the parent unit, data from the memory in the baby unit being transmitted from the baby unit 10 to the parent unit 30 and its Data Output Port via the transmitter and receiver of the units. In other embodiments, both of the baby unit and the parent unit may be provided with a VAR, memory and/or Data Output Port.

With general reference to FIGS. 1-7, the parent unit and baby unit collectively include a conventional radio frequency transmitter and receiver circuit, a conventional analog to digital microphone amplification circuit, a conventional digital to analog converter and a conventional speaker drive circuit. The radio frequency transmitter and receiver circuits of the parent unit and baby unit are complementarily tuned to establish a two way radio frequency communications link between the parent unit 30 and baby unit 10.

In use, baby unit 10 is used to monitor the sounds within the baby's environment and transmit those sounds for reproduction on parent unit speaker 44 of parent unit 30. Sounds from within the baby's environment are automatically recorded and stored as data for subsequent retrieval in the memory of one of the baby unit 10 and parent unit 30. The stored data is subsequently selectively downloadable from one of the baby unit 10 and parent unit 30 to a conventional electronic data storage device such as a memory key/jump drive, personal computer's hard drive, CD drive, or the like for long-term storage. In this manner, new sounds may be recorded in the memory, causing old sounds to be deleted from the memory, and yet a permanent/long-term record of the sounds may be retained for later reference and/or reproduction, e.g. to retain a record of your child's first words that will allow for audio reproduction of those words using conventional PC hardware and/or software, or the like.

It is noted that the embodiment of the baby monitor system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A baby monitoring system comprising:

a first unit comprising a first audio input transducer for converting a first acoustic input into a first input signal, first processing circuitry for creating a first output signal from said first input signal, and a transmitter for transmitting said first output signal; and a second unit comprising a second unit housing, a receiver for receiving said first output signal from said transmitter, said receiver being disposed within said second unit housing, second processing circuitry for creating a second output signal from said first output signal, said second processing circuitry being disposed within said second unit housing, an output transducer for converting output signals to acoustic output, said output transducer being mounted to said second unit housing, a memory configured to store in digital data form said first output signal, said memory being disposed within said second unit housing, and a data output port mounted on said second unit housing and operatively connected to said memory for communicating digital data stored in said memory.

2. The baby monitoring system of claim 1, further comprising:

voice activated recording circuitry operatively connected to said memory to selectively store data in said memory.

3. The baby monitoring system of claim 1, wherein said data output port of said second unit comprises a USB connector.

4. The baby monitoring system of claim 1, wherein one of said first and second processing circuitry processes one of said first input signal and said first output signal into a data file format compatible with commercially available computer software for reproducing audio signals.

5. The baby monitoring system of claim 4, wherein the data file format is selected from a group consisting of *.mpg, *.wav, *.avi, *.wma, *.snd, *.au, *.mid and *.asf data file formats.

6. A baby monitoring system comprising:

a first unit comprising a first audio input transducer for converting a first acoustic input into a first input signal, first processing circuitry for creating a first output signal from said first input signal, and a transmitter for transmitting said first output signal; and a second unit comprising a second unit housing, a receiver for receiving said first output signal from said transmitter, said receiver being disposed within said second unit housing, second processing circuitry for creating a second output signal from said first output signal, said processing circuitry being disposed within said second unit housing, an output transducer for converting output signals to acoustic output, said output transducer being mounted to said second unit housing, and a data output port mounted on said second unit housing for communicating digital data; and a memory key comprising a memory key housing, a data port mounted on said memory key housing and configured to operatively mate with said data output port of said second unit, and a memory configured to store in digital data form said second output signal received via said data output port, said memory being disposed within said memory key housing, said memory key being selectively connectable to and removable from said data output port of said second unit.

7. The baby monitoring system of claim 6, further comprising:

voice activated recording circuitry operatively connected to said data output port to selectively communicate data via said data output port.

8. The baby monitoring system of claim 6, wherein said data port of said memory key competes a USB connector.

9. The baby monitoring system of claim 6, wherein one of said first and second processing circuitry processes one of said first input signal and said first output signal into a data file format compatible with commercially available computer software for reproducing audio signals.

10. The baby monitoring system of claim 9, wherein the data file format is selected from a group consisting of *.mpg, *.wav, *.avi, *.wma, *.snd, *.au, *.mid and *.asf data file forms.

11. A baby monitoring system comprising:

a first unit comprising a first unit housing, a first audio input transducer for converting a first acoustic input into a first input signal, first processing circuitry for creating a first output signal from said first input signal, a transmitter for transmitting said first output signal, a memory configured to store in digital data form said first output signal, said memory being disposed within said first unit housing, and a data output port mounted on said first unit housing and operatively connected to said memory for communicating digital data stored in said memory; and a second unit comprising a receiver for receiving said first output signal from said transmitter, second processing circuitry for creating a second output signal from said first output signal, and an output transducer for converting output signals to acoustic output.

12. The baby monitoring system of claim 11, further comprising:

voice activated recording circuitry operatively connected to said memory to selectively store data in said memory.

13. The baby monitoring system of claim 11, wherein said data output port of said first unit comprises a USB connector.

14. The baby monitoring system of claim 11, wherein one of said first and second processing circuitry processes one of said first input signal and said first output signal into a data file format compatible with commercially available computer software for reproducing audio signals.

15. The baby monitoring system of claim 14, wherein the data file format is selected from a group consisting of *.mpg, *.wav, *.avi, *.wma, *.snd, *.au, *.mid and *.asf data file formats.

16. A baby monitoring system comprising:

a first unit comprising a first unit housing, a first audio input transducer for converting a first acoustic input into a first input signal, first processing circuitry for creating a first output signal from said first input signal, a transmitter for transmitting said first output signal, and a data output port mounted on said first unit housing for communicating digital data; and a second unit comprising a receiver for receiving said first output signal from said transmitter, second processing circuitry for creating a second output signal from said first output signal, and an output transducer for converting output signals to acoustic output; and a memory key comprising a memory key housing, a data port mounted on said memory key housing and configured to operatively mate with said data output port of said first unit, and a memory configured to store in digital data form said second output signal received via said data output port, said memory being disposed within said memory key housing, said memory key being selectively connectable to and removable from said data output port of said first unit.

17. The baby monitoring system of claim 16, further comprising:

voice activated recording circuitry operatively connected to said data output port to selectively communicate data via said data output port.

18. The baby monitoring system of claim 16, wherein said data port of said memory key comprises a USB connector.

19. The baby monitoring system of claim 16, wherein one of said first and second processing circuitry processes one of said first input signal and said first output signal into a data file format compatible with commercially available computer software for reproducing audio signals.

20. The baby monitoring system of claim 19, wherein the data file format is selected from a group consisting of *.mpg, *.wav, *.avi, *.wma, *.snd, *.au, *.mid and *.asf data file formats.

21. A baby monitoring system comprising:

a first unit comprising a first audio input transducer for converting a first acoustic input into a signal, and a transmitter for transmitting said signal; and a second unit comprising a second unit housing, a receiver for receiving said signal from said transmitter, said receiver being disposed within said second unit housing, an output transducer for converting signals to acoustic output, said output transducer being mounted to said second unit housing, a memory configured to store said signal in digital data form, said memory being disposed within said second unit housing, and a data output port mounted on said second unit housing and operatively connected to said memory for communicating digital data stored in said memory.

* * * * *